US007617943B2

(12) United States Patent
Willim

(10) Patent No.: US 7,617,943 B2
(45) Date of Patent: Nov. 17, 2009

(54) CRANE LATTICE BOOM AND A CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 131 days.

(21) Appl. No.: 11/158,882

(22) Filed: Jun. 22, 2005

(65) Prior Publication Data

US 2006/0016775 A1 Jan. 26, 2006

(30) Foreign Application Priority Data

Jun. 22, 2004 (DE) ..... 20 2004 009 782 U

(51) Int. Cl.
*B66C 23/64* (2006.01)

(52) U.S. Cl. ..... 212/347; 212/299

(58) Field of Classification Search ..... 212/177, 212/299, 347
See application file for complete search history.

(56) References Cited

U.S. PATENT DOCUMENTS

| | | | | |
|---|---|---|---|---|
| 2,382,767 | A * | 8/1945 | Zeilman | 212/299 |
| 3,049,242 | A * | 8/1962 | Stevens, Jr. et al. | 212/176 |
| 3,052,878 | A * | 9/1962 | Berry | 340/853.1 |
| 3,125,227 | A * | 3/1964 | Kauffman et al. | 212/177 |
| 3,149,730 | A * | 9/1964 | Mork | 212/177 |
| 3,198,345 | A | 8/1965 | Brekelbaum et al. | |
| 3,237,355 | A * | 3/1966 | McIntyre | 52/148 |
| 4,381,060 | A * | 4/1983 | Morrow et al. | 212/195 |
| 4,573,593 | A * | 3/1986 | Lietzau | 212/239 |
| 4,866,893 | A * | 9/1989 | McGinnis | 52/108 |
| 6,478,427 | B1 * | 11/2002 | Morris et al. | 352/243 |
| 6,758,356 | B1 * | 7/2004 | Zuehlke et al. | 212/270 |
| 7,137,518 | B2 * | 11/2006 | Irsch et al. | 212/299 |
| 2004/0026350 | A1 * | 2/2004 | Yerly | 212/347 |

FOREIGN PATENT DOCUMENTS

| | | | |
|---|---|---|---|
| DE | 7425234 | | 9/1976 |
| DE | 3113763 | | 10/1982 |
| DE | 35 10 116 | A1 * | 10/1985 |
| DE | 3640068 | | 7/1987 |
| DE | 69231008 | | 9/2000 |
| DE | 19929549 | | 1/2001 |
| DE | 10022658 | | 3/2001 |
| DE | 20020974 | | 4/2002 |
| DE | 20203443 | | 5/2003 |
| EP | 1 266 861 | A1 * | 6/2002 |
| EP | 1 369 373 | A2 * | 3/2003 |
| JP | 07-61773 | * | 3/1995 |
| JP | 11-35283 | * | 2/1999 |
| SU | 430041 | A * | 9/1976 |

* cited by examiner

*Primary Examiner*—Thomas J Brahan
(74) *Attorney, Agent, or Firm*—Dilworth & Barrese, LLP.

(57) ABSTRACT

The invention relates to a crane lattice boom comprising
at least two boom sections (3, 5, 7, 9) and
at least one guy support (27, 41) for a rope guy arrangement with a guy rope (13),
wherein the base (11) of the at least one guy support (27, 41) is designed such that it can be secured between two boom sections.

29 Claims, 3 Drawing Sheets

CRANE LATTICE BOOM AND A CRANE

BACKGROUND OF THE INVENTION

The invention relates to a crane lattice boom comprising two boom sections and a crane, in particular a mobile crane, having such a crane lattice boom.

In cranes, the maximum working load with long booms is limited by the lateral stiffness of the boom system. This applies in a particular degree with lattice-shaped booms and when the lattice is used in a steep position. This instability is further amplified e.g. with an inclined crane installation, unfavorable wind conditions or different temperature influences at the sides of the booms.

SUMMARY OF THE INVENTION

It is the object of the present invention to increase the lateral stiffness and thus the working load of the boom system even with a steep-standing boom.

This object is solved using a crane lattice boom, crane or, in particular a mobile crane, having the features herein. The description herein is also directed to advantageous embodiments.

A crane lattice boom in accordance with the invention comprises at least two boom sections and at least one guy support for a rope guy arrangement. The term "boom sections" is used in this connection for the individual lattice mast elements of the crane lattice boom. Guy supports of this type extend outwardly from the lattice boom in the operating state. Guy ropes are secured at their freely projecting ends or run over corresponding return pulleys whose ends are secured to the lattice boom itself, preferably to its head and base. The lateral stability of the lattice boom is significantly increased in this manner by the guy rope arrangement. The crane lattice boom in accordance with the invention has at least one guy support whose base is designed such that it can be installed between two boom sections. The design in accordance with the invention permits a flexible use of the lateral guy arrangement. The base of the at least one guy support can be mounted, depending on the necessity, between different boom sections. If the working loads to be lifted or the external conditions permit, the guy arrangement of the lattice boom in accordance with the invention can also be omitted in that the guy supports of the crane lattice boom are not fitted.

In a particularly preferred aspect of this crane lattice boom in accordance with the invention, at least two boom sections to be arranged behind one another and the base of the at least one guy support are designed such that the guy supports can be connected, preferably bolted to one another, both directly and while interposing the base of the at least one guy support. In this aspect, no changes are necessary to the boom sections themselves. If necessary, a decision can be made actually at the building site whether the guy supports should be fitted or not. In the affirmative case, a corresponding guy arrangement can be realized by a simple interposing of the base of the guy supports.

A single guy support can be provided in the crane lattice boom in accordance with the invention. The side of the lattice boom on which this guy support should optionally permit a lateral rope guy arrangement can be decided in dependence on the demands. However, a crane lattice boom is particularly advantageous and reliable in which at least two symmetrically arranged guy supports are provided which have a common base. Maximum security is ensured with such an arrangement due to the symmetrical design and the boom is also laterally stabilized by the rope guy arrangement even under changing external conditions.

Independent protection is provided by a crane lattice boom having the features herein. In this crane lattice boom in accordance with the invention, the guy rope of the rope guy arrangement of the at least one guy support has at least one rope length marking to set the rope length. Furthermore, a detector is provided for each rope guy arrangement which can detect the rope length markings provided at the rope guy arrangement.

If e.g. two guy supports each having a rope guy arrangement are provided, it is possible with the help of the rope length markings provided at both rope guy arrangements to align the boom absolutely straight on the installation of the crane and optionally to pull it straight.

With only one rope length marking per rope guy arrangement, this marking is arranged on the rope such that the optimum adjustment of the rope length in the crane operation is ensured with its help.

It is, however, particularly advantageous for a plurality of rope length markings to be provided at pre-determined intervals per guy rope in order to be able to monitor the rope length on the guying of the rope and, optionally, to be able to set and detect different rope lengths.

The rope length markings and the respective detector can e.g. cooperate mechanically in order to permit a detection of the rope length. In a preferred embodiment, a contact-free detector is provided per rope guy arrangement which can detect corresponding rope length markings. The detector can thus e.g. have an ultrasonic transmitter/receiver unit and the rope length markings can be formed by ultrasonic reflectors. In other embodiments, the detector is formed by a sensor head, e.g. an optical sensor, which can detect correspondingly made rope length markings. An electronic sensor is likewise possible which detects correspondingly designed rope length markings in a capacitive or inductive manner. Finally, the rope length markings can also be formed by transponders which can be polled by a corresponding transducer in a manner known per se.

The pre-tensioning of the rope guy arrangement can be achieved in a particularly simple manner with the help of at least one winch which is e.g. pivotably supported at the base of the boom. The respective guy rope can be hauled in and pre-tensioned with the help of a rope winch of this type. It is particularly favorable in this connection for the winch to be controllable in dependence on a detector for the detection of the rope lengths. An automatic setting of the desired rope length is possible in this manner.

Provision can be made for the rope lengths to be set as desired initially with the help of the winches and then to be blocked with the help of a rope brake. In this connection, the rope brake is designed such that it can accept the maximum rope tension occurring in operation even with additional lateral strains, e.g. wind influences.

However, an embodiment is particularly reliable and simple to handle in which two guy supports are provided which advantageously extend away from the crane lattice boom in opposite directions in operation, with a winch being associated with each of the two guy supports and having a drive torque dimensioned such that it can generate the maximum rope tension occurring in operation in a driving manner. It is thereby ensured that the boom can be pulled straight on a possible slanted position or on side wind.

In order also to achieve stabilization in the luffing plane of the boom, the guy supports can extend upwardly from their base in a V shape. A flexible aspect provides that the at least one guy support includes a joint with whose help part of the guy support can be pivoted toward or away from the luffing plane of the boom such that the plane which a rope guyed with the guy support defines has a different inclination to the luffing plane. A corresponding joint can be provided directly at the base of the guy support which is installed between two boom sections of the boom. An embodiment of this type permits an individual adaptation to the external circumstances and necessities.

Optimum lateral stability can be achieved with two guy supports which extend in opposite directions away from the base and thus away from the boom at right angles to the luffing plane of the boom.

To achieve practical transport dimensions for the boom or for the guy supports, the at least one guy support can be made in divisible form.

The at least one guy support can be fixedly connected to a base element to be installed between the boom sections. A particularly advantageous embodiment provides for the guy support to have a pivot axis which is aligned such that at least part of the guy support can be folded onto the boom. With this embodiment, the crane boom can already be completely premounted and favorable transport dimensions can be achieved by folding of the guy support onto the boom. In addition, with this embodiment, the rope guy arrangement can be subsequently established after installation of the base element of the guy support between two boom sections with a folded-on guy support by unfolding the guy support into its operating position. Finally, it is possible with this embodiment also to fold the guy support on to reduce the rotation radius or the passage width when the crane is set up.

A simple possibility to pre-tension the rope guy arrangement results when the guy supports have a return pulley at their heads via which the rope guy arrangement runs. The pre-tensioning can then be carried out in the whole guy arrangement by the pre-tensioning only at the rope end.

The outer ends of the ropes of the rope guy arrangement are secured to the head of the boom. Provision can be made, to increase the restoring force, for the hinge points to be offset outwardly e.g. with the help of a frame.

With a crane lattice boom in accordance with the invention having a base element of one or more guy supports to be arranged between two boom sections, great flexibility in application is ensured. With a crane lattice boom in accordance with the invention having rope length markings at the guy ropes and having corresponding detection devices, a simple setting of the desired pre-tensioning of the rope guy arrangements is ensured. In particular when two rope guy arrangements are provided which effect a guying perpendicular to the luffing plane, a particularly good lateral stability of the crane lattice boom is ensured. With an embodiment of this type, an optimum and straight alignment of the crane lattice boom is already possible on the installation of the crane. This property is particularly advantageous with mobile cranes which are to be made particularly flexible in use in order also to permit a reliable, stable and simple installation here when a mobile crane is provided with a lattice boom.

BRIEF DESCRIPTION OF THE DRAWINGS

The invention will be explained in detail with reference to the enclosed figures. There are shown.

DESCRIPTION OF THE PREFERRED EMBODIMENTS

Figure 1:
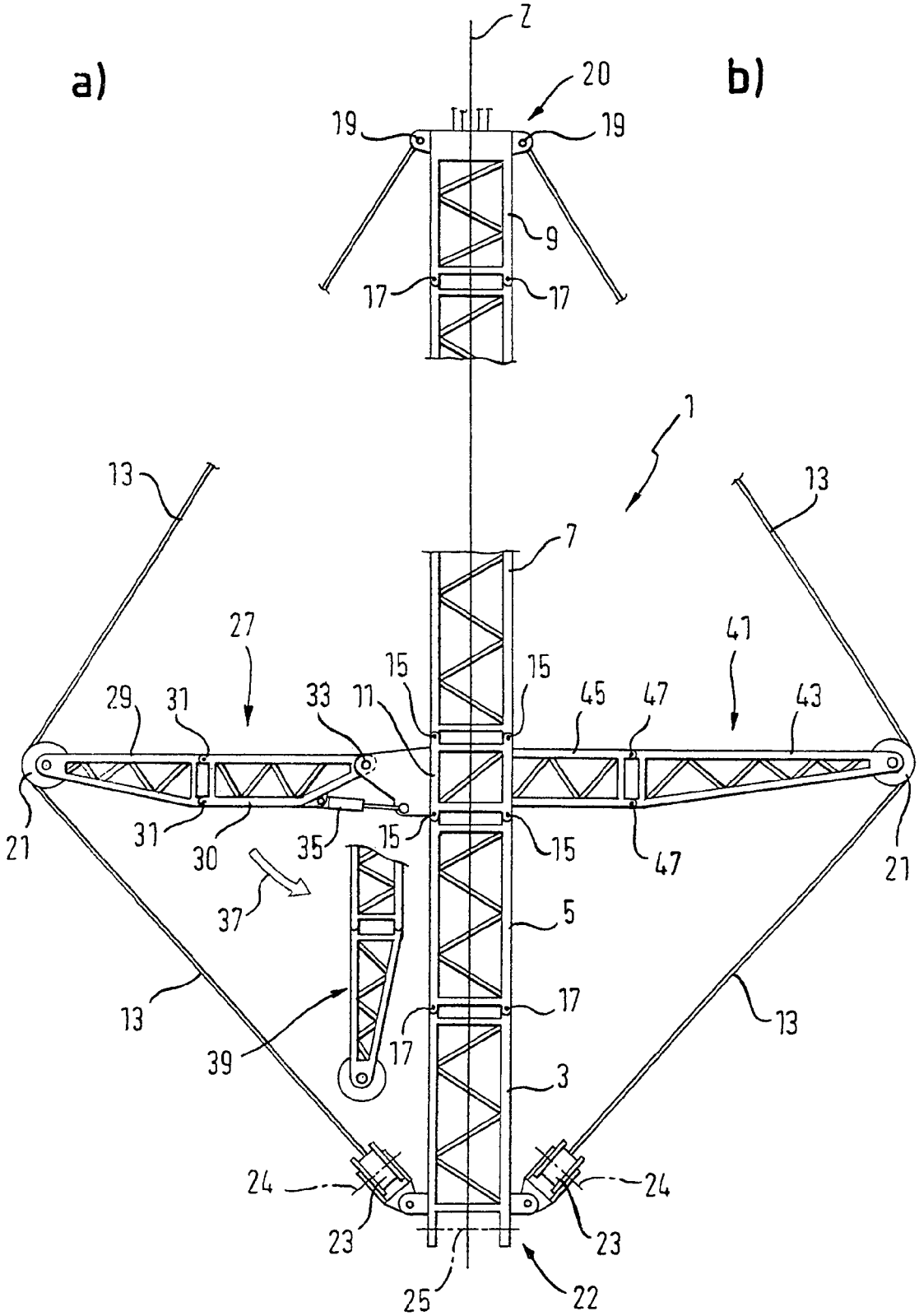
FIG. 1: a combined representation of two embodiments of a crane lattice boom in accordance with the invention, with FIG. 1*a* showing part of an embodiment with an unfoldable guy support and FIG. 1*b* showing part of an embodiment with a fixed guy support.

FIG. 1 shows two embodiments of a crane lattice boom in accordance with the invention in a combined representation. FIG. 1*a* shows one half of a crane lattice boom having an unfoldable guy support 27. When realizing an embodiment of this type, a corresponding mirror-image aspect is also to be provided to the left of the imagined line Z.

On the other hand, FIG. 1*b* shows part of an embodiment with a fixed guy support 41. When realizing this embodiment, a corresponding mirror-image aspect is also to be provided to the left of the imagined line Z.

Both embodiments have a lattice boom 1 which has a plurality of boom sections 3, 5, 7, 9. The individual boom sections are bolted to one another in a manner known per se at the points marked by 17 in operation. The base element 11 of the guy support is located between the boom sections 5 and 7. The base element 11 is designed at the connection points 15 with the boom sections 5 and 7 such that it can be bolted directly to the boom sections 5 or 7 without any further intermediate pieces or adapters. For this purpose, the connection points 15 of the guy support base element 11 pointing to the head 20 of the boom 1 are identical to the connection points 15 of the boom section 5 pointing in the direction of the head 20 of the boom 1.

On the other hand, the connection points 15 of the guy support base element 11 pointing in the direction of the base 22 of the boom 1 are identical to the connection points 15 of the boom section 7 facing in the direction of the base 22 of the boom 1. It is ensured in this manner that the boom sections 5 and 7 can be bolted to one another directly or with the interposition of the guy support base element 11. The total lattice boom 1 is pivotable about a horizontal luffing axis 25 in the luffing plane perpendicular to the figure plane, e.g. are secured to a hinge section of a movable crane. The boom 1 is not shown true to scale in FIG. 1 and can also comprise a higher number of boom sections. In this respect, the boom 1 and the guy ropes 13 are shown in a broken representation.

Guy supports 27 and 41 extend outwardly at the guy support base element 11. In the embodiment of FIG. 1*a*, guy supports which corresponding to the guy support 27 shown extend away from the guy support base 11 in both directions. The guy support 27 in the example shown consists of two parts 29 and 30 which are bolted to one another at the points 31. The guy support 27 has a pivot axis 33. 35 designates a hydraulic cylinder with whose help the guy support 27 can be folded onto the boom 1 about the pivot axis 33 in the direction 37. The folded-on position is additionally shown schematically in FIG. 1*a* and is designated with 39.

In the embodiment of FIG. 1*b*, fixed guy supports 41 are provided. Two guy supports are provided which correspond to the guy support 41 shown in FIG. 1 and extend away from the boom 1 in opposite directions. The guy supports 41 likewise consist of two parts 43, 45 which are bolted to one another at the points 47. The element 45 is fixedly connected to the guy support base element 11.

Both embodiments of the guy supports 27, 41 shown in FIG. 1 have return pulleys 21 at their freely projecting ends around which a guy rope 13 is laid. They are fixedly connected to the head 20 of the boom 1 at the hinge points 19. The hinge points 19 can be located directly at the boom 1 or can be laid outwardly via a frame construction (not shown) to increase the restoring forces of the rope guy arrangements. The guy ropes 13 of the rope guy arrangements run from the points 19 over the return pulleys 21 to rope winches 23 which can be rotatingly driven about the axes 24 to tension the guy ropes 13.

The guy support base element 11 is naturally dimensioned such that all strains of the boom 1 can be transmitted and normal forces resulting from the rope guy arrangement can be led in.

Figure 2:
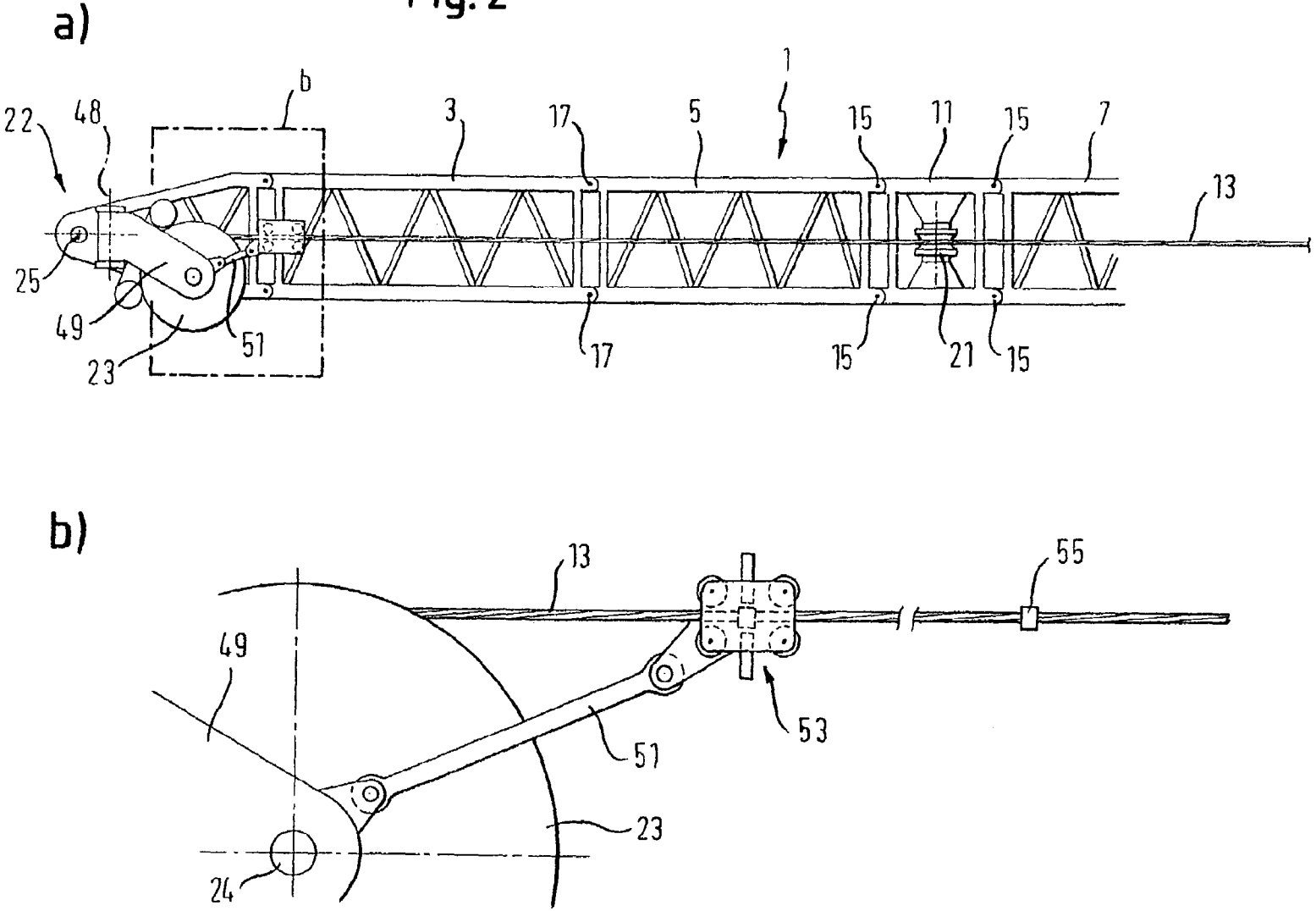
FIG. 2: a side view of a crane lattice boom in accordance with the invention, with FIG. 2*a* showing part of the boom and FIG. 2*b* showing the detail designate by b) in FIG. 2*a*.

FIG. 2*a* shows part of a boom 1 in accordance with the invention in a side view. FIG. 2*b* shows the detail designated by b) in FIG. 2*a*. The rope winch construction of the rope winches 23 can in particular be recognized here.

The axle 24 of the rope winch 23 is supported in a holder 49 which is pivotable about an axis 48. Depending on the length of the guy supports used or depending on between which boom sections of the boom 1 the guy supports are mounted, a different angle is created between the rope guy arrangement 13 and the boom 1 in the region of the boom base, which can be recognized at the left in FIG. 2*a*. It is ensured by the pivotability of the rope winch 23 about the axis 48 that the rope 13 always runs off the rope winch 23 rotatable about the axle 24 in a perpendicular manner.

A sensor element 53 is arranged with a holder 51 at the securing portion 49 of the rope winch 23. Rope markings 55 are provided at pre-determined intervals on the rope 13. The rope markings 55 and the sensor 53 are matched to one another such that when a rope marking 55 runs into the sensor element 53, a corresponding signal is generated and the rope length wound onto the winch 23 or unwound from the winch 23 can be determined in this manner. The sensor head 53 can e.g. be an optical sensor or a mechanical sensor. An electronic sensor is likewise possible which detects appropriately designed rope markings 55 in a capacitive or inductive way. The signal of the sensor 53 goes to a control apparatus (not shown).

Figure 3:
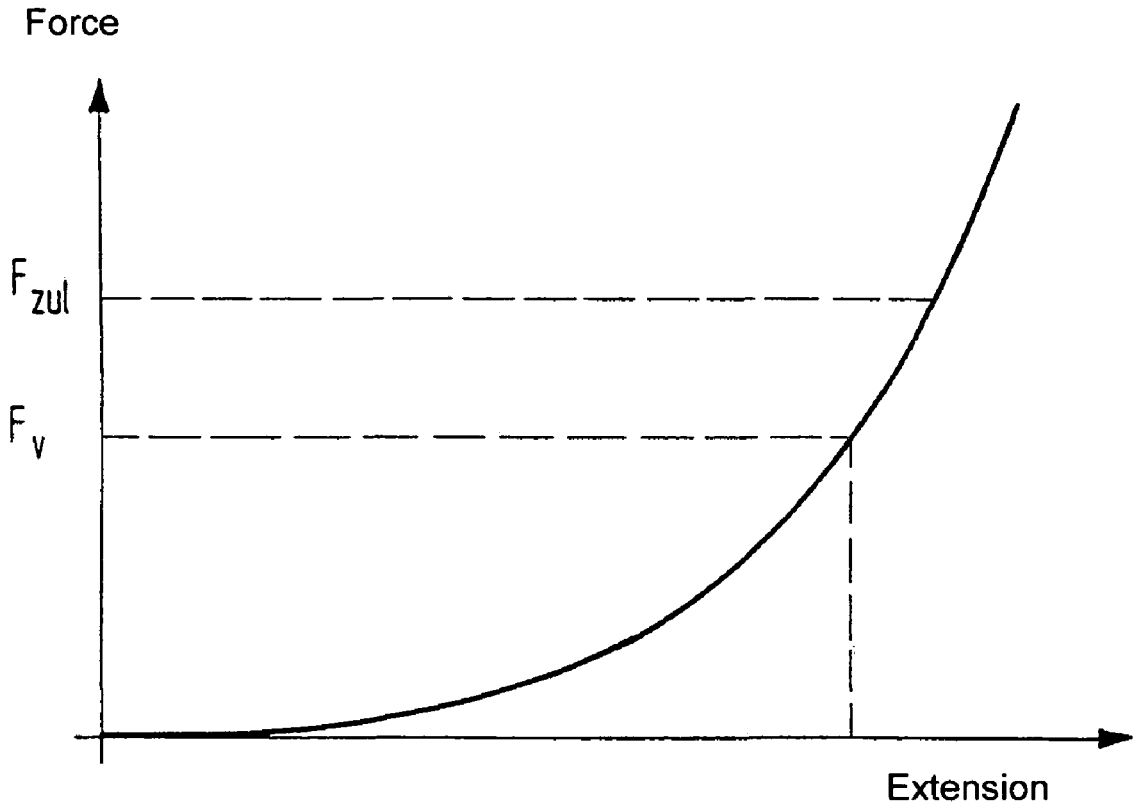
FIG. 3: a force/extension diagram of a guy rope.

FIG. 3 shows the force/extension diagram of a rope which can be used as a guy rope. As the extension increases, the force required to achieve a further extension increases disproportionally. A permitted force $F_{zul}$ can be determined from the rope properties which ensures that no rope break is threatened. A pre-tension force $F_v$ is drawn which lies in the steeply increasing range of the elasticity curve of the guy rope.

The embodiment in accordance with the invention of FIG. 1*b* can be used as follows. On the assembly of the crane with the boom 1 at the usage site, a decision can be made whether a lateral guy arrangement is necessary or not. The decision criteria here are the desired working load and external conditions. The lattice boom 1 is bolted together from the individual boom sections 3, 5, 7, 9. The guy support base element 11 is bolted between the boom sections 5 and 7. In the embodiment of FIG. 1*a*, a first guy support element such as corresponds to the element 45 shown is located on each side at this guy support base element 11. A further element 43 is bolted to the element 45 at the respective connection points 47 in order to form the guy support 41. A respective rope guy arrangement 13 is laid around the return pulley 21 of the guy supports 41 and each are secured to the points 19 at the head 20 of the boom 1. The guy ropes 13 can now be tensioned using the winches 23.

The pre-tensioning of the ropes 13 can be set at the mounted crane. The winches 23 are equipped with a strong drive/brake so that the maximum rope forces can be applied. The pre-tension is selected such that the guy ropes 13 are already located in the steeply rising region of the elasticity curve shown in FIG. 3. The selected pre-tension force corresponds to the value $F_v$ there. The desired pre-tensioning can be set using the sensor 53 and the rope markings 55. The winches 23 coil up the ropes 13 for so long until the desired rope marking runs into the reading head 53. If this is done on both sides of the boom 1, it is ensured that both guy arrangements 13 have exactly the same rope length.

It is ensured in this manner that, with a lateral force acting on the boom 1, the restoring force from the additional strain of the one guy rope on the one side of the boom 1 and the fast relief of the other guy rope on the other side of the boom 1 is already very high with small lateral deformations.

A lateral deformation occurring at the side due to a different temperature effect or to a slanted position of the crane can also be eliminated by the high tension forces in the guy ropes 13.

The possibly relatively low modulus of elasticity of the guy ropes 13 and the large rope extension resulting from this, in particular with low rope loads (see FIG. 3) is largely compensated in this process by a high pre-tensioning force in that the pre-tensioning force is selected in the already steeply rising range of the elasticity curve.

In an embodiment of FIG. 1*a*, the guy support base element 11 is likewise bolted between the boom sections 5 and 7. As also in the embodiment of FIG. 1*b*, no intermediate pieces or adapters are required for this purpose. The guy support base element 11 is also dimensioned here such that the strains on the boom 1 can be transmitted and normal forces resulting from the lateral rope guy arrangement can additionally be led in. The use of the guy supports 27 corresponds to the already described use of the guy supports 41.

In the embodiment of FIG. 1*a*, the guy arrangement of the rope guy arrangement 13 can moreover also take place by the unfolding of the guy supports 25 about the pivot axis 33 in that the guy support 27 is only subsequently unfolded with the help of the hydraulic cylinder 35. In this case, the drive of the winches 23 can be made substantially smaller since they do not have to serve the generation of the large pre-tension. However, with this application, the brakes of the rope winches 23 naturally have to absorb the maximum rope tension force.

In the embodiment of FIG. 1*a*, it is possible to fold the guy supports 27 onto the lattice boom 1 when e.g. only low loads are lifted in which the guy arrangement is not required. The rotation radius or the passage width of the crane can thus be reduced.

The remaining advantages of the embodiment of FIG. 1*a* correspond to the already described advantages of the embodiment of FIG. 1*b*.

It is common to both embodiments of FIG. 1 that the guy support base element 11 can be bolted between the boom sections as necessary in order to install guy supports. No special apparatuses are required at the guy supports for this purpose. An optimum and flexible adaptation to the external circumstances is therefore possible with a crane lattice boom of this type in accordance with the invention and a working load increase and an increase in the lateral stiffness can be achieved by use of the guy supports. Using the winches, the ropes can be tensioned for so long thanks to the rope length markings and the corresponding detectors on the installation of the crane until the markings corresponding to the desired pre-tension are detected by the sensor. Exactly the same rope lengths can thus be set in the rope guy arrangements on both sides of the boom. The boom is thus aligned absolutely straight and also stable with side wind or with a slanted position of the crane.

The above-described embodiment has both the flexible aspect with guy supports securable between two boom sections and the rope length markings and detectors therefor advantageous for the setting of a reliable and stable operation. The respective advantages can also be achieved with crane lattice beams in which either only the flexible aspect with guy supports securable between two boom sections or the rope length markings and detectors provided for the setting of the desired rope length are realized.

The invention claimed is:

1. A crane lattice boom comprising the combination of at least two co-linear lattice boom sections (3, 5, 7, 9), at least one guy support (27, 41) having a width at its inner end for a rope guy arrangement with a guy rope (13) terminating at a connection point disposed at an end of the lattice boom sections, a short base (11) having a length corresponding to the width of the at least one guy support at its inner end being fixedly interposed between two elongated boom sections (5, 7) arranged one behind the other of the boom sections (3, 5, 7, 9) via non-pivoting rigid connection points with each of boom sections (5, 7), the at least one guy support extending outwardly from the base, a pulley (21) mounted at an end of the at least one guy support (27, 41) opposite the boom sections (3, 5, 7, 9) and about which said guy rope (13) passes, and means for winding and unwinding said guy rope (13) over the pulley (21) to tension the guy rope (13), wherein said guy rope is secured to at least one of the lattice boom sections.

2. A crane lattice boom in accordance with claim 1, wherein said two lattice boom sections (5, 7) are arranged to be interposed between two additional elongated lattice boom sections (3, 9), and wherein the said base is non-rotatable with respect to the boom sections.

3. A crane lattice boom in accordance with claim 1, comprising at least two guy supports (27, 41) extending outwardly from the base (11).

4. A crane lattice boom in accordance with claim 1, comprising two guy supports extending in opposite directions.

5. A crane lattice boom in accordance with claim 1, wherein the at least one guy support comprises a joint by which at least one part of the guy support can be pivoted toward or away from a luffing plane of the crane lattice boom such that the plane defined by a rope guyed with the at least one guy support has a different inclination to the luffing plane.

6. A crane lattice boom in accordance with claim 1, wherein the at least one guy support (27, 41) is composed of at least two parts (29, 30; 43, 45) arranged to be couplable to one another.

7. A crane lattice boom in accordance with claim 1, wherein the at least one guy support (27) has a pivot axis (32) which is arranged such that at least one part (29, 30) of the guy support (27) can be folded onto the boom (1).

8. A crane lattice boom in accordance with claim 1, additionally comprising hinge points (19) for a plurality of guy ropes (13) of the rope guy arrangement being outwardly offset at a tip of the boom (1).

9. A crane lattice boom in accordance with claim 1, wherein the at least one guy support includes a pair of guy supports extending outwardly from the base and being disposed substantially perpendicular to a longitudinal axis of the crane lattice boom.

10. A crane lattice boom, comprising the combination of at least two co-linear lattice boom sections (3, 5, 7, 9), at least one guy support (27, 41) having a width at its inner end for a rope guy arrangement with a guy rope (13) terminating at a connection point disposed at an end of the lattice boom sections, a short base (11) having a length corresponding to the width of the at least one guy support at its inner end being securable between two (5, 7) of the boom sections (3, 5, 7, 9) via non-pivoting rigid connection points with each of boom sections (5, 7), the at least one guy support extending outwardly from the base, a guy rope (13) of a rope guy arrangement having at least one rope length marking (55) for the setting of the rope length, said guy rope being secured to at least one of the lattice boom members and a detector (53) arranged for the detection of the rope length markings (55) provided at the rope guy arrangement.

11. A crane lattice boom in accordance with claim 10, wherein the guy rope (13) of the rope guy arrangement has a plurality of rope length markings (55) at pre-determined intervals.

12. A crane lattice boom in accordance with claim 10, wherein the detector of the rope guy arrangement comprises a contact-free detector (53).

13. A crane lattice boom in accordance with claim 10, wherein the at least one guy support (27, 41) has a return pulley (21) at its head for the guy rope (13) of the rope guy arrangement.

14. A crane lattice boom in accordance with claim 10, wherein the sensor (53) is arranged to detect rope length markings (55) in a contact-free manner.

15. A crane lattice boom in accordance with claim 14, wherein the sensor (53) is an ultrasonic, optical or electronic sensor.

16. A crane lattice boom comprising the combination of at least two co-linear lattice boom sections (3, 5, 7, 9), at least one guy support (27, 41) having a width at its inner end for a rope guy arrangement with a guy rope (13) terminating at a connection point disposed at an end of the lattice boom sections, and a short base (11) having a length corresponding to the width of the at least one guy support at its inner end being securable between two (5, 7) of the boom sections (3, 5, 7, 9) via non-pivoting rigid connection points with each of boom sections (5, 7), the at least one guy support extending outwardly from the base, wherein a rope guy arrangement has a winch (23) arranged for the pre-tensioning of a guy rope (13) of the at least one guy support (27, 41).

17. A crane lattice boom in accordance with claim 16, wherein the winch (23) is controllable in dependence on a signal of at least one detector (53).

18. A crane lattice boom in accordance with claim 16, wherein the at least one guy support includes two guy supports with which the winch (23) is respectively associated which has a drive torque dimensioned such that it can apply a maximum rope tension occurring in operation in a driving manner.

19. A crane lattice boom in accordance with claim 16, wherein the guy rope (13) of the rope guy arrangement has at least one rope length marking (55) for the setting of the rope length, and additionally comprising a detector (53) arranged for the detection of the rope length markings (55) provided at the rope guy arrangement (13).

20. A crane lattice boom in accordance with claim 19, wherein the winch (23) is mounted upon a base (22) of one of the boom sections (3).

21. A crane lattice boom in accordance with claim 16, wherein the at least one guy support (27) has a pivot axis (33) which is arranged such that at least one part (29, 30) of the guy support (27) can be folded onto the boom (1), the winch (23) pre-tensions the guy rope (13) when the part (29, 30) of the guy support (27) is folded against the boom (1), and the guy rope (13) pre-tensioning is secured with a rope brake prior to pivoting of the guy support (27) away from the boom (1).

22. A crane lattice boom in accordance with claim 16, wherein the at least one guy support (27, 41) has a return pulley (21) at its head for the guy rope (13) of the rope guy arrangement.

23. A crane lattice boom in accordance with claim 16, wherein the winch (23) is mounted upon a base (22) of one of the boom sections (3).

24. A crane lattice boom comprising the combination of at least two co-linear lattice boom sections (3, 5, 7, 9), at least one guy support (27, 41) having a width at its inner end for a rope guy arrangement with a guy rope (13) terminating at a connection point disposed at an end of the lattice boom sections, and a short base (11) having a length corresponding to the width of the at least one guy support at its inner end being securable between two (5, 7) of the boom sections (3, 5, 7, 9) via non-pivoting rigid connection points with each of boom sections (5, 7), the at least one guy support extending outwardly from the base, wherein a rope guy arrangement has a winch (23) arranged for the pre-tensioning of a guy rope (13) of the at least one guy support (27, 41)

wherein the at least one guy support (27) has a pivot axis (33) which is arranged such that at least one part (29, 30) of the any support (27) can be folded onto the boom (1), the winch (23) pre-tensions the guy rope (13) when the part (29, 30) of the guy support (27) is folded against the boom (1), and the guy rope (13) pre-tensioning is secured with a rope brake prior to pivoting of the guy support (27) away from the boom (1) and additionally comprising an hydraulic cylinder (35) mounted upon the base (11) and guy support (27) to pivot the guy support (27) about the pivot axis (33) after pre-tensioning of the guy rope (13).

25. A crane lattice boom comprising the combination of at least two co-linear lattice boom sections (3, 5, 7, 9), at least one guy support (27, 41) having a width at its inner end for a rope guy arrangement with a guy rope (13) terminating at a connection point disposed at an end of the lattice boom sections, and a short base (11) having a length corresponding to the width of the at least one guy support at its inner end being securable between two (5, 7) of the boom sections (3, 5, 7, 9) via non-pivoting rigid connection points with each of boom sections (5, 7), the at least one guy support extending outwardly from the base, wherein a rope guy arrangement has a winch (23) arranged for the pre-tensioning of a guy rope (13) of the at least one guy support (27, 41), wherein the winch (23) is mounted upon a base (22) of one of the boom sections (3, 5, 7, 9), and additionally comprising a holder (49) rotatably supporting the winch (23) about an axis of rotation (24) of the winch (23) and, in turn, rotatably mounted upon the base (22) of one of the boom sections (3) about an axis of rotation (48) extending perpendicularly to a luffing axis (25) of the boom (1).

26. A crane lattice boom comprising the combination of at least two co-linear lattice boom sections (3, 5, 7, 9), at least one guy support (27, 41) having a width at its inner end for a rope guy arrangement with a guy rope (13) terminating at a connection point disposed at an end of the lattice boom sections, and a short base (11) having a length corresponding to the width of the at least one guy support at its inner end being securable between two (5, 7) of the boom sections (3, 5, 7, 9) via non-pivoting rigid connection points with each of boom sections (5, 7), the at least one guy support extending outwardly from the base, wherein a rope guy arrangement has a winch (23) arranged for the pre-tensioning of a guy rope (13) of the at least one guy support (27, 41), wherein the guy rope (13) of the rope guy arrangement has at least one rope length marking (55) for the setting of the rope length, and additionally comprising a detector (53) arranged for the detection of the rope length markings (55) provided at the rope guy arrangement (13), wherein the winch (23) is mounted upon a base (22) of one of the boom sections (3), and additionally comprising a holder (49) rotatably supporting the winch (23) about an axis of rotation (24) of the winch (23) and, in turn, rotatably mounted upon the base (22) of one of the boom sections (3) about an axis of rotation (48) extending perpendicularly to a luffing axis (25) of the boom (1), and a holder (51) for the sensor (53) mounted upon the holder (49) for the winch (23) such that the guy rope (13) with the at least one rope length marking (55) passes through the sensor (53).

27. A crane lattice boom in accordance with claim 26, wherein the sensor (53) is arranged to detect rope length markings (55) in a contact-free manner.

28. A crane lattice boom in accordance with claim 27, wherein the sensor (53) is an ultrasonic, optical or electronic sensor.

29. A crane lattice boom comprising the combination of at least two co-linear lattice boom sections (3, 5, 7, 9), at least one guy support (27, 41) having a width at its inner end for a rope guy arrangement with a guy rope (13) terminating at a connection point disposed at an end of the lattice boom sections, a short base (11) having a length corresponding to the width of the at least one guy support at its inner end being securable between two elongated boom sections (5, 7) arranged one behind the other of the boom sections (3, 5, 7, 9) via non-pivoting rigid connection points with each of boom sections (5, 7), a pulley (21) mounted at an end of the at least one guy support (27, 41) opposite the boom sections (3, 5, 7, 9)and about which said guy rope (13) passes, and means for winding and unwinding said guy rope (13) over the pulley (21) to tension the guy rope (13).

* * * * *